US006899046B2

(12) United States Patent
Searle et al.

(10) Patent No.: US 6,899,046 B2
(45) Date of Patent: May 31, 2005

(54) SHIPPING METHANOL FOR A METHANOL TO OLEFIN UNIT IN NON-METHANOL CARRIERS

(75) Inventors: Ronald G. Searle, Houston, TX (US); Michael Peter Nicoletti, Houston, TX (US); Cor F. Van Egmond, Pasadena, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 322 days.

(21) Appl. No.: 10/304,409

(22) Filed: Nov. 26, 2002

(65) Prior Publication Data

US 2004/0099195 A1 May 27, 2004

(51) Int. Cl.[7] ..... B63B 25/08
(52) U.S. Cl. ..... 114/74 R
(58) Field of Search ..... 114/74 R, 74 T, 114/74 A; 169/62

(56) References Cited

U.S. PATENT DOCUMENTS

| | | | | |
|---|---|---|---|---|
| 2,877,747 A | | 3/1959 | Happell | 122/435 |
| 3,781,407 A | | 12/1973 | Kamijo et al. | 423/242 |
| 3,945,944 A | | 3/1976 | Kang | 252/455 |
| 4,098,412 A | | 7/1978 | Shakshober | 214/15 D |
| 4,134,732 A | * | 1/1979 | Jackson | 422/198 |
| 4,163,455 A | | 8/1979 | Hebert et al. | 134/167 R |
| 4,259,976 A | * | 4/1981 | Gould | 137/13 |
| 4,503,281 A | | 3/1985 | Hoelderich et al. | 585/640 |
| 4,665,249 A | | 5/1987 | Mao et al. | 585/408 |
| 4,777,321 A | | 10/1988 | Harandi et al. | 585/640 |
| 4,814,535 A | | 3/1989 | Yurchak | 585/408 |
| 4,814,536 A | | 3/1989 | Yurchak | 585/408 |
| 4,826,662 A | | 5/1989 | Mao et al. | 422/190 |
| 4,857,667 A | | 8/1989 | Harandi et al. | 585/403 |
| 5,028,400 A | | 7/1991 | Harandi et al. | 422/211 |
| 5,041,690 A | | 8/1991 | Harandi et al. | 568/695 |
| 5,059,738 A | | 10/1991 | Beech, Jr. et al. | 585/469 |
| 5,166,455 A | | 11/1992 | Chin et al. | 568/697 |
| 5,167,937 A | | 12/1992 | Harandi et al. | 422/190 |
| 5,189,975 A | | 3/1993 | Zednik et al. | 114/74 |
| 5,313,006 A | | 5/1994 | Knifton | 568/698 |
| 5,335,615 A | | 8/1994 | Bjorkman | 114/74 R |
| 5,398,629 A | | 3/1995 | Wasenius | 114/74 R |
| 5,491,273 A | | 2/1996 | Santiesteban et al. | 585/639 |

(Continued)

FOREIGN PATENT DOCUMENTS

| | | | |
|---|---|---|---|
| JP | 05 310181 | 11/1993 | B63B/25/08 |
| WO | WO 02/00579 | 1/2002 | C07C/11/02 |

OTHER PUBLICATIONS

Germanischer Lloyd, Hambrug, DE, "Part I Seagoing Ships", Rules for Classification and Construction, vol. 1 Ship Technology, pp. 1–76 (1998).

Yang et al., "Physical and Chemical Properties and Handling Aspect", vol. 16, Chapter 2, pp. 554, Northwestern University, Evanston, Illinois (1994).

*Primary Examiner*—Stephen Avila

(57) ABSTRACT

The invention relates to a process for modifying tanker ships. More specifically, the invention is directed to a process for modifying a non-methanol-carrying tanker to carry a methanol cargo destined for a methanol to olefin reaction system. The process includes providing a tanker having one or more holds that previously stored a non-methanol material. The process includes one or more of the following steps: (1) cleaning the holds of the crude/naphtha-carrying tanker to remove residual deposits, wherein the holds previously stored a non-methanol material; (2) providing a fire suppression system specially designed to prevent methanol fires; and (3) replacing methanol intolerant pump seals and flange gaskets in the tanker with methanol resistant seals and gaskets.

76 Claims, 1 Drawing Sheet

U.S. PATENT DOCUMENTS 5,638,845 A 6/1997 Oliver et al. ..... 134/167 R
5,714,662 A 2/1998 Vora et al. ..... 585/640
5,899,162 A 5/1999 Beaupreet et al. ..... 114/74 A
6,021,848 A 2/2000 Breivik et al. ..... 166/344
6,041,726 A 3/2000 Filek ..... 114/74 R
6,121,504 A 9/2000 Kuechler et al. ..... 585/640
6,166,282 A 12/2000 Miller ..... 585/638
6,230,809 B1 * 5/2001 Korsgaard ..... 166/352
2003/0006047 A1 * 1/2003 Silverstein et al. ..... 169/47
2003/0051651 A1 * 3/2003 Husain et al. ..... 114/74 R

* cited by examiner

SHIPPING METHANOL FOR A METHANOL TO OLEFIN UNIT IN NON-METHANOL CARRIERS

FIELD OF THE INVENTION

This invention is to a process for modifying a tanker vessel. More particularly, the invention concerns converting a conventional crude or naphtha-carrying tanker to a tanker suitable for carrying methanol that is to be used in a methanol to olefin reaction system.

BACKGROUND OF THE INVENTION

Methanol is required for methanol-to-olefin (MTO) and many non-MTO reactor systems. Conventionally, methanol is produced at a methanol production facility that is far from the MTO or non-MTO reactor system. High quality methanol-carrying tankers have been provided to ship the methanol from the methanol production facility to the reactor system.

Methanol for non-MTO processes, e.g., MTBE and formaldehyde synthesis, must be of a high quality. A typical non-MTO process requires the methanol in its feedstock to be at least Grade A, preferably Grade AA. Because conventional methanol conversion processes require very high quality methanol, conventional methanol tankers include methanol holds that are coated with Zinc or epoxy to reduce contamination from the hold's inner surface. Additionally, large methanol-carrying tankers, e.g., Aframax class ships at 105,000 Dead Weight Tons (DWT), having tank holds greater than 3,000 $m^3$ have implemented expensive nitrogen blanketing or "inerting" systems to prevent methanol contamination from the blanketing gas and to reduce the risk of methanol fires. Ships with less than 3,000 $m^3$ holds, e.g., Panamax class ships at 45,000 DWT, are not required by the SOLAS (Safety of Life at Sea) U.N. resolution to have a gas blanketing system. A Nitrogen blanketing system includes very large nitrogen adsorbers or generators, which often take up a significant amount of deck space. In conventional methanol carriers, an entire deck under the bridge house can be dedicated to the nitrogen generation equipment. Additionally, the costs associated with building and maintaining a specialized methanol tanker having coated hold surfaces and an inerting system are very high. Thus, the need exists for reducing the costs associated with transporting methanol, particularly with transporting methanol to MTO reactor systems.

SUMMARY OF THE INVENTION

It has been discovered that a methanol feedstock for a methanol to olefin (MTO) process unexpectedly need not be of as high quality as methanol for non-MTO processes. Contaminants in methanol resulting from uncoated tanker holds and/or from a blanketing medium will not significantly impact the MTO process. Therefore, when using ships with tank holds greater than 3,000 $m^3$ a non-nitrogen blanketing system is sufficient to satisfy the SOLAS resolution and deliver an acceptable MTO feedstock. Crude and naphtha-carrying tankers are plentiful and generally much less expensive to build or modify than conventional large methanol-carrying tankers because they typically do not have coated holds or expensive inerting systems. The costs associated with shipping methanol destined for an MTO reactor system may be greatly reduced from conventional methanol shipping costs by modifying a conventional crude or naphtha-carrying tanker to carry MTO grade methanol.

In one embodiment, the present invention provides a relatively inexpensive process for modifying conventional crude/naphtha-carrying tankers to ship MTO grade methanol. The process includes one or more of the following steps: (1) cleaning the holds of the crude/naphtha-carrying tanker to remove residual deposits, wherein the holds previously stored a non-methanol material; (2) providing a fire suppression system specially designed to prevent methanol fires; and (3) replacing methanol intolerant pump seals and flange gaskets in the tanker with methanol resistant seals and gaskets. The fire suppression system includes a fire suppression conduit system for delivering the alcohol resistant fire suppression agent to the tanker holds.

The invention is also directed to a tanker modified by the above-described process.

The invention also provides a methanol blanketing system including a blanketing medium generator in a tanker for generating a blanketing medium selected from the group consisting of: exhaust gases from a diesel engine, a gas oil engine, a kerosene engine, a gasoline engine and a methanol engine. Additionally or alternatively, the blanketing medium generator is a diesel, gas oil, kerosene, methanol or gasoline burner having a combustion chamber. Both the engine and the burner style blanketing medium generators provide a satisfactory blanketing medium, which optionally includes water-saturated carbon dioxide. A conduit system is also provided, which is in communication with the blanketing medium generator and one or more holds. The blanketing medium generator directs the blanketing medium through the conduit system to the one or more holds, the holds being at least partially filled with a fluid cargo comprising methanol.

The present invention also provides a process for unloading methanol from a tanker. The process includes withdrawing at least a portion of the methanol from a hold, and replacing the volume of the withdrawn methanol with a blanketing medium. The blanketing medium is selected from the group consisting of: exhaust from a diesel, gas oil, kerosene, methanol, or gasoline engine. Additionally or alternatively, the blanketing medium is provided by a diesel, gas oil, kerosene, methanol or gasoline burner. The blanketing medium may include carbon dioxide, carbon monoxide, soot, SOX, particulate contaminants or a combination thereof.

BRIEF DESCRIPTION OF THE DRAWING

This invention will be better understood by reference to the Detailed Description of the Invention when taken together with the attached drawing, wherein.

DETAILED DESCRIPTION OF THE INVENTION

Figure 1:
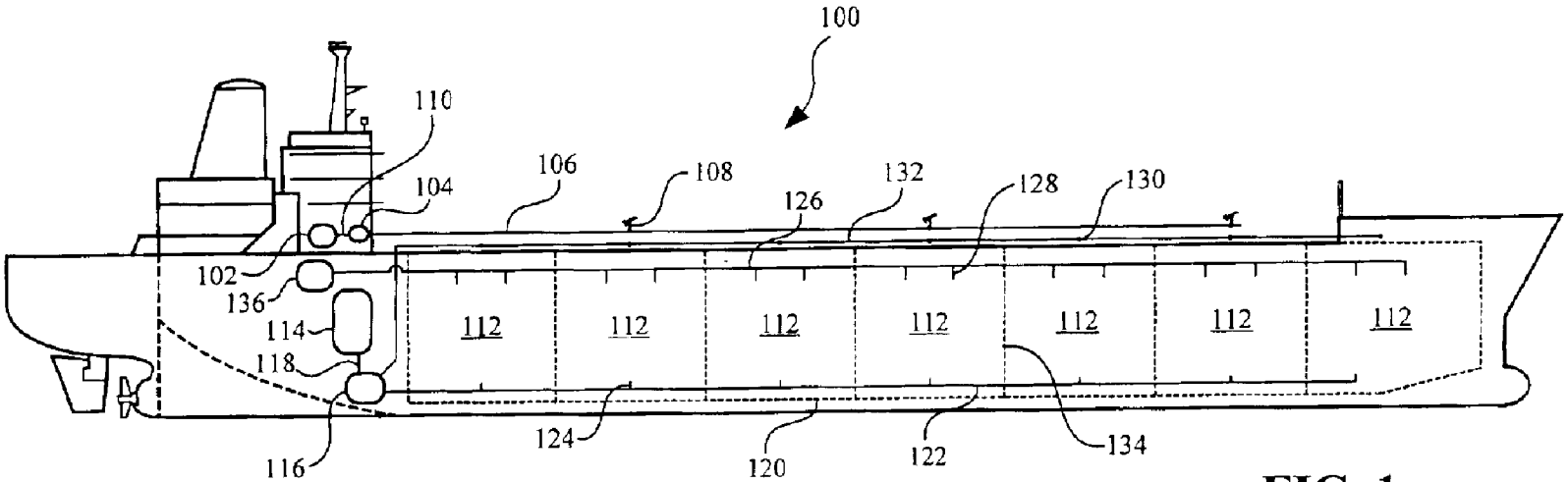
FIG. 1 illustrates a partial cross-sectional side view of a tanker than has been modified in accordance with the present invention

The present invention is directed to a process for modifying a tanker for carrying methanol destined for use as a feedstock in a methanol to olefin (MTO) reaction system. The process includes: (1) cleaning the holds of the crude/naphtha-carrying tanker to remove residual deposits; (2) providing a fire suppression system for delivering an alcohol-resistant fire suppression agent; and (3) replacing methanol intolerant seals and/or gaskets in the tanker with methanol resistant seals and/or gaskets. The process optionally includes providing a blanketing system, which delivers a blanketing medium to the holds. In another embodiment, the invention is directed to a process for converting methanol to light olefins wherein the methanol does not pass specification for Grade A or AA methanol. In other embodiments, the invention is directed to a tanker modified by the above process, a methanol blanketing system, a process for unloading methanol from a tanker, and a process for providing methanol to an MTO reaction system.

The reaction of methanol to olefins, described in more detail below, involves contacting methanol with a molecular sieve catalyst under conditions effective to convert at least a portion of the methanol to light olefins, e.g., ethylene and propylene. It has been discovered that a methanol-containing stream containing a certain level of contaminants surprisingly may be, depending on the type and amount of contaminant, provided directly to an MTO reaction system without significantly affecting the MTO reaction process. More specifically, it has been discovered that the catalysts implemented in the MTO reaction process will not be significantly deactivated by these contaminants. Vaporization of the methanol-containing feedstock prior to its introduction into an MTO reactor also limits particulate and salt contamination. Thus, one embodiment of the present invention is directed to a process for converting methanol in a "dirty" methanol stream to light olefins. A "dirty" methanol stream is defined herein as a methanol-containing stream that does not pass specification for Grade AA methanol.

Grade AA methanol is a methanol-containing stream that passes certain federally prescribed tests. Grade A methanol may contain more contaminants, e.g., water, than Grade AA methanol and is also defined by federally prescribed tests. The table below provides the requirements for Grades A and AA methanol.

TABLE 1

Tests and Requirements for Grades A & AA Methanol

| Test | Grade A | Grade AA |
|---|---|---|
| 1. IMPCA 001 Methanol | 99.85 wt. % Min. | 99.85 wt. % Min. |
| 2. ASTM D346 Water | 1500 ppm wt. Max. | 1000 ppm wt. Max. |
| 3. ASTM D1209 Color | 5 mg pt/liter Max. | 5 mg pt/liter Max. |
| 4. ASTM D1078 Distillation | 149° F. ± 0.9 | 149° F. ± 0.9 |
| 5. ASTM D1363 $KMnO_4$ test at 68° F. | 30 minutes | 30 minutes |
| 6. ASTM D1722 Hydrocarbons | Pass test | Pass test |
| 7. Visual Appearance | Clear & Colorless | Clear & Colorless |
| 8. ASTM D891 Specific Gravity @ 68° F. | 0.791–0.792 | 0.791–0.792 |
| 9. ASTM D1613 Acid Number | <0.03 mg KOH/g | <0.03 mg KOH/g |
| 10. ASTM E346 Carbonyl number | <0.02 mg KOH/g | <0.02 mg KOH/g |
| 11. ASTM D3961 Sulfur | 0.5 ppmw | 0.5 ppmw |

An important advantage of the present discovery is that a non-conventional methanol tanker, which might cause contamination of the methanol stored therein, may be used to transport methanol destined for an MTO reaction system if the tanker is modified according to the present invention. Although the methanol unloaded from these modified tankers may contain one or more contaminants, the methanol is still suitable for an MTO reaction system. The tanker may or may not have previously carried a non-methanol material, such as naphtha or crude oil.

One embodiment of the present invention is a process for modifying a tanker to carry methanol. The process includes providing a tanker having one or more holds that previously stored and/or was designed to hold a non-methanol material. A fire suppression system is provided for delivering an alcohol resistant fire suppression agent to the holds. The fire suppression system preferably includes a conduit system for delivering the alcohol resistant fire suppression agent to the holds. The time required to accomplish the conversion on an existing standard Aframax product carrier is 2 to 5 months depending on the design of the ship.

Conventional fire suppression systems for tankers that are designed to carry a non-methanol cargo, e.g., naphtha or crude oil, typically include a fire suppression system storage tank, a pump and conduit lines, e.g., pipes, which transfer the fire suppression agent to outlet nozzles, e.g., turrets, which optionally are used to direct the suppression agent at a fire in one or more of the holds. Typically, the fire suppression agent for a non-methanol carrying tanker is a protein based or AFFF foam extinguishing material, which may be ineffective or unsatisfactory against a methanol fire. Specifically, alcohols may break down these conventional fire suppression agents causing them to reduce their extinguishing characteristics. The IBC code dictates the requirements for methanol fire suppression including the type and amount of foam required. Thus, in one embodiment of the invention, the fire suppression system is supplemented, replaced or modified to allow the suppression system to adequately deliver an alcohol-resistant fire suppression agent to the tanker holds.

A preferred alcohol-resistant fire suppression agent is a foam material, such as UNITOR Unitol fire suppression foam or other fire suppression foam having increased surface tension so the foam will not break apart when it contacts the methanol. The foam fire suppression agent preferably includes a surfactant, which prevents the foam from breaking up upon its release onto a methanol fire. Because foam materials are less dense than conventional fire suppression agents used in non-methanol carrying tankers, the tanker's fire suppression system should be modified in order to be able to adequately deliver the foam fire suppression agent to the tanker holds. Approximately twice as much alcohol resistant fire suppression agent than conventional fire suppression agent would be required. Accordingly, in accordance with the present invention, a fire suppression agent storage tank having increased volume should be provided that is capable of storing an alcohol-resistant fire suppression agent. The existing tank may be enlarged through well known techniques, or supplemented with an additional fire suppression agent storage tank. Alternatively, the existing tank is removed and replaced with a larger storage tank better suited for storing an alcohol-resistant storage tank.

Similarly, the conduit lines for transferring the fire suppression agent to the one or more outlets should be modified, supplemented with a second conduit system or replaced with a second conduit system to provide a final conduit system capable of delivering the alcohol-resistant fire suppression agent to the outlets and, ultimately, to the holds or tanker deck at a flow rate to satisfactorily enable the extinguishing of a methanol fire. Preferably, the overall cross sectional area of the final conduit system will be larger than the preexisting conduit system in order to allow an increased flow capacity necessary for delivering a foam fire suppression agent to the outlets. Additionally or alternatively, the existing fire suppression conduit lines may be supplemented with an additional set of conduit lines to enable satisfactory delivery of the methanol-resistant fire suppression agent to the outlets.

The tanker also will likely have a preexisting pump adapted to deliver a liquid fire suppression agent to the conduit system. Pumping an alcohol-resistant fire suppression agent with the preexisting pump may not provide sufficient flow characteristics for the alcohol-resistant fire suppression agent. Accordingly, in one embodiment of the present invention, the preexisting pump is replaced with a second pump adapted to pump the alcohol-resistant fire suppression agent at a sufficient volumetric flow rate. The second pump is adapted to pump the alcohol-resistant fire suppression agent from the storage tank to the conduit system and, ultimately, to the outlets and holds. In another embodiment, the preexisting pump is supplemented by a second pump, and the two or more pumps will operate simultaneously or intermittently in order to provide desirable pumping characteristics for the alcohol-resistant fire suppression agent. In another embodiment, the preexisting pump is modified, e.g., by increasing the size of the impeller, in order to provide desirable pumping characteristics for the alcohol-resistant fire suppression agent.

The fire suppression system optionally includes one, two, three, four or more fire suppression agent outlets. Each outlet preferably is an aimable turret adapted to direct and deliver the alcohol-resistant fire suppression agent toward the one or more holds or the tanker deck in order to extinguish any methanol fire present. Each turret preferably may be controlled by an individual who is able to aim the turret at a fire in one or more of the holds or on the deck of the tanker. Alternatively, a remote operating system is provided to operate the turret. In one embodiment, the preexisting nozzles are adapted to deliver the alcohol-resistant fire suppression agent. For example, the preexisting nozzles may be removed, replaced or modified with nozzles capable of delivering the alcohol-resistant fire suppression agent to the holds or the tanker deck. Each turret should be modified to include a nozzle creating a sufficient flow rate for the alcohol-resistant fire suppression agent. The fire suppression system also optionally includes one, two, three, four or more fire suppression agent turrets with modified nozzles.

In addition to providing a fire suppression system capable of delivering an alcohol-resistant fire suppression agent, the process for modifying a tanker to carry methanol preferably includes providing a gas blanketing system or an inerting system. A gas blanketing system is a system for delivering a gas blanketing medium to one or more of the tanker holds. The gas blanketing medium optionally comprises exhaust from a gasoline, kerosene, gas oil, methanol or diesel burning engine. Additionally or alternatively, the blanketing medium is provided by a diesel, gas oil, kerosene, gas oil, methanol or gasoline burner. A blanketing medium from a burner is referred to as flue gas. For tankers carrying methanol, a gas blanketing system is particularly desirable in order to reduce the amount of oxygen that contacts the methanol thereby decreasing the risk of a methanol fire. During the unloading of the methanol cargo, the blanketing medium is fed into the hold to replace the volume of methanol that is removed from the tanker hold.

An inerting system is a type of gas blanketing system wherein an inert gas, referred to generally as an inerting medium, such as nitrogen, acts as the blanketing medium. For example, in an inerting system, a nitrogen generator may be provided to supply nitrogen to the one or more holds. Nitrogen inerting systems, although more expensive than other blanketing systems, are well-known to be desirable for large methanol tankers because the inert gas does not impart contaminants to the methanol. Ships having tank holds smaller than 3,000 $m^3$ are not required by the SOLAS resolution to blanket methanol with a blanketing medium, and hence do not incur the cost of providing a blanketing system.

As it has been discovered that a dirty methanol stream may be effectively directed to an MTO reaction system, a tanker that previously carried or was designed to carry a non-methanol cargo may be modified to carry methanol destined for an MTO reaction system by providing a gas blanketing system including a gasoline, kerosene, gas oil, diesel or methanol burning engine or a diesel, gas oil, kerosene, methanol or gasoline burner. The blanketing medium from the engine or burner is directed to the one or more methanol-containing holds. Although the blanketing medium from an engine or burner, depending on the fuel, will contain components such as CO, $CO_2$, and $SO_x$ and soot that will contaminate the methanol stored in the holds, the contaminated methanol is surprisingly still suitable for serving as a feedstock for an MTO reaction system. Specifically, soot and other particulates are caught in an on-site tank system. Unburned hydrocarbons and sulfur are in small enough quantities as not to be considered an issue. Secondary contaminants, which are formed from one or more of these contaminants, also may contaminate the methanol stored in the holds, although the methanol is still suitable for use in an MTO reaction system. For example, $CO_2$ in methanol may form a secondary contaminant such as carbonic acid. However, the presence of carbonic acid does not render the methanol cargo unsuitable for use in an MTO reaction system. Unlike conventional methanol-implementing processes such as MTBE and formaldehyde syntheses, the methanol feed preheat and vaporization section of an MTO reaction system will vaporize methanol away from soot particles contained in the feedstock. Limited amounts of $SO_x$, CO and carbonic acid may vaporize with the methanol and be transported to the reactor without significantly detrimental effects on conversion or catalyst activity. Accordingly, if an unmodified tanker includes a gas blanketing system wherein the blanketing medium was exhaust or flue gas from a gasoline, kerosene, gas oil, or diesel engine or burner, the invention comprises placing methanol in the one or more holds and blanketing the methanol with the exhaust or flue gas from the gasoline, kerosene, gas oil or diesel engine or burner. Unlike conventional large methanol-carrying tankers, the methanol is stored for transportation under a blanketing medium wherein the blanketing medium is exhaust from an engine or flue gas from a burner rather than nitrogen from a nitrogen generator. The blanketing medium generator optionally is upgraded by installing scrubbers to reduce the amount of soot, moisture, particulates and $SO_x$ in the gas to be used as the blanketing medium.

In another embodiment, the tanker is provided with an inerting system wherein the blanketing medium is an inert gas such as nitrogen. In this embodiment, the inerting system comprises an inerting medium generation unit, e.g., a nitrogen generator, which provides the inerting medium. The inerting system optionally is connected to a preexisting gas piping system thereby reducing installation costs.

Optionally, the tanker is provided with a methanol engine or burner, which forms exhaust or flue gas that serves as the blanketing medium. A blanketing medium from a methanol engine or burner is particularly clean and will not significantly contaminate the methanol cargo. In this embodiment, a small portion of the methanol cargo may be provided as fuel for the methanol engine or burner. One or more pumps, control devices and conduit lines may be provided to transport methanol from the one or more holds to the methanol engine or burner fuel tank or directly to the methanol engine or burner.

Regardless of the type of blanketing medium (engine exhaust, flue gas, inert gas or other blanketing medium), the blanketing system preferably includes one or more conduit lines, pumps and control devices for directing the blanketing medium to the one or more holds. If the tanker includes a plurality of laterally oriented holds, the blanketing system preferably includes at least two longitudinally extending conduit lines, which direct the blanketing medium to the holds. Each conduit line includes at least one outlet for each respective hold. The blanketing medium is directed through the lines and exits the conduit lines via the outlets. Optionally, the conduit line or lines include a plurality of outlets, e.g., 2, 3, 4 or more, for each respective hold.

Thus, one embodiment of the present invention is a methanol blanketing system including a blanketing medium generator, e.g., a diesel, gasoline, methanol, gas oil, or kerosene engine or burner, in a tanker for generating a blanketing medium. The blanketing medium is selected from the group consisting of exhaust from a diesel engine, exhaust from a kerosene engine, exhaust from a methanol engine, exhaust from a gas oil engine, and exhaust from a gasoline engine. Additionally or alternatively, the blanketing medium is selected from the group consisting of flue gas from a diesel burner, flue gas from a kerosene burner, flue gas from a methanol burner, flue gas from a gasoline burner, and flue gas from a gas oil burner. Thus, the blanketing medium can include carbon dioxide, carbon monoxide, soot, $SO_x$, particulate contaminants and combinations thereof.

Another embodiment of the present invention is a process for unloading methanol from a tanker. The process includes withdrawing methanol form a hold and replacing the volume of withdrawn methanol with a blanketing medium selected from the group consisting of exhaust from a diesel engine, exhaust from a kerosene engine, exhaust from a gas oil engine, exhaust from a gasoline engine, and exhaust from a methanol engine. Additionally or alternatively, the blanketing medium is selected from the group consisting of flue gas from a diesel burner, flue gas from a kerosene burner, flue gas from a methanol burner, flue gas from a gasoline burner, and flue gas from a gas oil burner. Thus, the blanketing medium may include carbon dioxide, carbon monoxide, soot, $SO_x$, particulate contaminants and combinations thereof.

Many non-methanol materials, such as crude and naphtha, leave hydrocarbon deposits on the inner surface of tanker holds after the material has been unloaded therefrom. Although a certain level of contaminants is acceptable for methanol destined for an MTO reactor, ideally the level of hydrocarbon contaminants is minimized. Accordingly, the process for modifying a tanker to carry methanol also preferably includes cleaning the one or more holds with a cleaning agent to remove residual deposits formed by the non-methanol cargo. Ideally, the holds are first washed, e.g., hydroblasted at about 5,000 psi or mechanically washed at about 300 psi, with a first cleaning agent. The first cleaning agent preferably comprises water. The holds are then washed with a second cleaning agent comprising an emulsifier, such as GYRO Voyage Clean, a high solvency base emulsifier and cleaner with oil-sea water emulsification abilities. After being washed with the emulsifier, the emulsifier is rinsed from the holds with a water rinse. The first and second cleaning agents and the water rinse preferably are delivered to the tanker holds with a cleaning device such as a "Butterworth" system. If necessary, the internal surfaces of the holds may be hand washed and/or further chemically cleaned. The bottoms of the tanks may also be "mucked" of all residual hydrocarbons. All slops generated during the hold cleaning process above would need to be removed and disposed of properly. Approximately 800 tons of slops will be generated for a standard Aframax vessel in crude oil service. A wall test is preferably performed after the holds have been washed by the above-described process. The downtime for cleaning the holds is 1 to 3 weeks although no downtime would be incurred for cleaning if the tanker is cleaned during repositioning. Limited residual hydrocarbon contamination of the methanol will not significantly effect conversion or catalyst activity in an MTO reaction system. Naphtha includes light hydrocarbons ($C_4$–$C_5$) and heavy hydrocarbons ($C_6$+). Limited amounts of the light hydrocarbons may vaporize with the methanol and be transported to the reactor without significantly detrimental effects on conversion or catalyst activity. The methanol should vaporize away from the heavy hydrocarbon contaminants in the MTO feed vaporization system thereby separating the heavy hydrocarbons from the methanol feedstock destined for the MTO reactor.

Unlike conventional methanol-carrying tanker holds, which are coated with a protective layer comprising zinc, holds in tankers designed to carry crude or naphtha are typically formed of uncoated carbon steel or coated with epoxy, which may break down in the presence of methanol thereby contaminating the methanol cargo. In accordance with the present invention, a methanol cargo is directed to the one or more uncoated tanker holds, zinc clad or, less desirably, epoxy-coated holds. Although the uncoated inner surface of the one or more tanker holds formed of carbon steel may impart discoloring contaminants such as rust (iron oxide) or leached metals to the methanol, it has been discovered that methanol stored in uncoated carbon steel holds is still acceptable for use as a feedstock in an MTO reaction system. Specifically, the discoloration caused by these contaminants is not an issue for an MTO reaction system, which may utilize uncoated carbon steel piping. Also, unlike conventional methanol-implementing processes such as MTBE and formaldehyde syntheses, the methanol feed preheat and vaporization section of an MTO reaction system will vaporize methanol away from soot particles and rust contained in the feedstock. Similarly, although an epoxy coating layer may break down in the presence of methanol, methanol contamination therefrom does not render the methanol cargo unsatisfactory for use as a feedstock in an MTO reaction system. Optionally, any existing epoxy coating layer is blasted off of the cargo holds thereby providing holds having uncoated inner surfaces.

Conventional crude and naphtha carrying tankers include cargo pumping systems comprising cargo pumps, which, when desired, pump the cargo out of the holds and off the tanker into on-shore storage tanks. The cargo pumps preferably include bronze or Ni—Al-Bronze casings, which are acceptable for use with a methanol cargo. However, carbon steel or stainless steel (SCS 14) internals and ductile cast iron casings are preferred. If fitted, mechanical seals are to be retrofitted with stainless steel components and buna N or EPDM elastomers. Control valves are submerged within each hold and are remotely operable to allow the cargo to be pumped out of the holds and through conduit lines to the on-shore storage tanks. These control valves are typically controlled hydraulically. The hydraulic system, which causes these valves to open, uses a hydraulic oil comprising hydrocarbons, which may leak into the holds causing hydrocarbon contamination of the methanol. In contrast, conventional-methanol carrying tankers include a non-hydraulic mechanical or contained hydraulic mechanical means for removing methanol therefrom. Although hydrocarbon contamination may result from implementing a hydraulic control valve system with a methanol cargo, the resulting contaminated methanol is acceptable for use as a feedstock in an MTO reaction system for the reasons discussed above regarding residual crude and naphtha hydrocarbon contamination of methanol. Nevertheless, the control valves optionally include one or more alcohol intolerant seals or gaskets, which may break down in the presence of methanol thereby causing control valve failure and significant hydrocarbon contamination. Thus, one embodiment of the present invention includes replacing these alcohol intolerant seals and gaskets with alcohol resistant seals and gaskets. Ideally, all flange gaskets, slip type coupling joints, manhole and access hatch gaskets should be refit with material suitable for methanol service. Preferably, the alcohol resistant seals and gaskets are formed of synthetic fiber with nitrile binder or an equivalent thereof.

Additionally, one or more preexisting ladders that provide for entry into the one or more holds may be coated or uncoated. Uncoated carbon steel ladders or ladders coated with epoxy, although subjecting the methanol cargo to contamination, will not render the methanol cargo unfit for use as a feedstock in an MTO reaction system. Optionally, the ladders are blasted to remove any coating thereon, or the ladders are retrofitted with SUS 316 stainless steel (minimum 22 mm square bar).

The process for modifying a crude or naphtha carrying tanker to carry methanol may be implemented in tankers of all sizes having varying ratings for dead weight tonnage (DWT). Preferably, the present invention is implemented in an Aframax size tanker rated at 75,000 to 125,000 DWT, although the invention may be implemented in a Suezmax tanker rated at 125,000 to 180,000 DWT, a very large crude carrier (VLCC) rated at 200,000 to 300,000 DWT or an ultra large crude carrier (ULCC) rated at 300,000 to 500,000 DWT. The invention also can be implemented in smaller tankers such as Panamax tankers rated at 45,000 to 65,000 DWT, Handy Size tankers rated at 20,000 to 30,000 DWT, or Handymax tankers rated at approximately 35,000 DWT. However, in these smaller tankers, a gas blanketing system is unnecessary. The total deadweight tonnage of the modified tanker may be at least 20,000; 35,000; 70,000; or at least 1-25,000 DWT.

FIG. 1 illustrates a tanker, generally designated 100, that has been modified by the above-described process. Tanker 100 includes a plurality of uncoated holds 112 for storing methanol. Each hold includes side surfaces 134 defining the side limits thereof and separating a hold from an adjacent hold. Each hold also includes a bottom surface 120 defining the bottom limit thereof. The side surface 134 and the bottom surface 120 are preferably formed of an uncoated material such as carbon steel.

The modified tanker 100 includes a fire suppression system adapted to provide an alcohol-resistant fire suppression agent to the one or more holds 112 or the tanker deck. The fires suppression system includes a fires suppression agent storage tank 102, which stores the fire suppression agent. The storage tank 102 includes a pump line 110 in fluid communication with pump 104. In the event of a fire in one or more of the holds or on the deck of the tanker 100, the pump 104 is activated to pump the alcohol-resistant fire suppression agent from the storage tank 102 through the pump line 110 and pump 104 and into fires suppression header line 106. Header line 106 directs the fire suppression agent to one or more, preferably a plurality of, fire suppression agent outlets 108. FIG. 1 illustrates three fire suppression agent outlets 108, each of which is an aimable turret. In the event of a fire, a remote control mechanism or an individual directs one or more of the aimable turrets towards the fire in order to extinguish it.

FIG. 1 also illustrates a cargo pumping mechanism adapted to pump the methanol cargo off of the ship or to circulate the methanol through the holds 112. The cargo pumping mechanism includes a methanol intake line 122, which extends longitudinally through the tanker holds 112. Although the intake line 122 is illustrated internally with respect to the holds 112, the intake line could be oriented externally to the holds 112. The intake line 122 includes a plurality of methanol inlets 124, each inlet being adapted to receive methanol from a respective hold. FIG. 1 illustrates one methanol inlet 124 per hold 112 although a plurality of inlets 124 may be oriented with respect to a single hold 112. Pump motor 114 operates on motor shaft 118 to power cargo pump 116. Cargo pump 116 creates a pressure drop on line methanol intake line 122 thereby causing methanol to be supplied thereto through methanol inlet 124. The methanol received in methanol inlet 124 flows through methanol intake line 122, through pump 116 and into methanol discharge line 132. Methanol discharge line 132 is also longitudinally oriented with respect to tanker 100 and extends over the top of the holds 112. The discharge line 132 includes a plurality of methanol outlets 130, which optionally are in fluid connection with a series of external conduit lines for unloading the methanol from tanker 100. Alternatively, the outlets 130 may extend inside each enclosed hold 112 and discharge the methanol back into the holds 112 thereby providing for cargo circulation between the holds.

A gas blanketing system is also shown including a gas blanket medium generator 136. The generator may be a gasoline, kerosene, methanol, or diesel burning engine or an inert gas generator such as a nitrogen generator. The gas blanketing medium from gas blanket medium generator 136 is directed through gas blanket conduit line 126, which extends longitudinally over each of the enclosed holds 112. The conduit line 126 directs the gas blanketing medium to a plurality of blanket outlets 128, each of which extends inside a respective enclosed hold 112. In this manner the gas blanketing medium is directed to each of the holds 112. Two blanket outlets 128 are shown in FIG. 1 for each hold 112 although each hold may have a single blanket outlet or more than two blanket outlets.

As indicated above, a methanol-containing stream that does not pass specification for Grade A or Grade AA methanol may, depending on the level and type of contaminant, be fed directly to an MTO reaction system. For example, it has been discovered that contaminants from a gas blanketing system or from the uncoated inner surface of one or more conduit lines or holds will not render methanol unsuitable for an MTO reaction process. Accordingly, another embodiment of the present invention is a process for converting methanol to light olefins. The process includes providing a feedstock comprising methanol and a contaminant and contacting the methanol with a catalyst in a reactor under conditions effective to convert at least a portion of the methanol to the light olefins. The feedstock does not pass specification for Grade A or AA methanol. Optionally, the contaminant is selected from the group consisting of: soot, rust, $SO_x$, $CO_2$, carbonic acid, and hydrocarbons.

Methanol that is stored in an unlined tank such as a conventional tanker hold will likely receive contaminants from the metal surfaces thereof. For example, rust (iron oxide) on the inner surfaces of the tank or hold may break away from the inner surface thereby contaminating the methanol with rust particles. These rust particles may cause the methanol to fail specification for Grade A or Grade AA methanol. More specifically, rust may cause the methanol to fail one or more of tests ASTM D1363, ASTM D1613, ASTM E346 and the visual appearance test for Grade A or AA methanol.

Also, the gas blanketing system may contribute to the contamination of methanol causing the methanol to fail specification for Grade A or Grade AA methanol. More specifically, soot from the blanketing medium may cause the methanol to fail one or more of test ASTM D1209 or the visual appearance test for Grade A or AA methanol. Additionally, $CO_2$ from the blanketing medium may cause the methanol to fail test ASTM D1363 for Grade A or AA methanol. The $CO_2$ may form carbonic acid in methanol, which can cause the methanol to fail test ASTM D1363 for Grade A or AA methanol. Additionally, $SO_x$ from the blanketing medium may cause the methanol to fail test ASTM D3961 for Grade A or AA methanol.

As indicated above, hydrocarbons from hydraulic oil or from deposits on the inner surface of the one or more of the holds may also contribute to the contamination of methanol causing the methanol to fail specification for Grade A or Grade AA methanol. More specifically, the hydrocarbons from the hydraulic oil or deposits from a previous non-methanol cargo may cause the methanol to fail one or more of tests ASTM D1722 and the visual appearance test for Grade A or AA methanol.

A tanker modified by the above-described invention may cause the contamination of methanol stored therein causing the methanol to not pass specification for Grades A or AA methanol. However, the present invention of converting methanol in a methanol-containing feedstock to light olefins, wherein the feedstock does not pass specification for Grade A or AA methanol, is not limited to a methanol-containing stream that has been unloaded from a tanker modified by the above-described processes.

Another embodiment of the present invention is directed to a process for providing methanol to an MTO reactor system. The process includes providing a methanol-containing stream and directing the methanol-containing stream to the MTO reactor system. In this embodiment, the methanol-containing stream does not pass specification for Grade AA methanol.

The preferred MTO process and reaction conditions will now be described in more detail. Preferably, the conditions in the MTO reactor including the pressure, temperature, weight hourly space velocity (WHSV), etc., are conducive to converting the methanol to light olefins, as discussed in more detail below. Typically, molecular sieve catalysts have been used to convert oxygenate compounds to light olefins. Silicoaluminophosphate (SAPO) molecular-sieve catalysts are particularly desirable in such a conversion process, because they are highly selective in the formation of ethylene and propylene.

The feedstock preferably contains one or more aliphatic-containing compounds that include alcohols, amines, carbonyl compounds for example aldehydes, ketones and carboxylic acids, ethers, halides, mercaptans, sulfides, and the like, and mixtures thereof. The aliphatic moiety of the aliphatic-containing compounds typically contains from 1 to about 50 carbon atoms, preferably from 1 to 20 carbon atoms, more preferably from 1 to 10 carbon atoms, and most preferably from 1 to 4 carbon atoms.

Non-limiting examples of aliphatic-containing compounds include: alcohols such as methanol and ethanol, alkyl-mercaptans such as methyl mercaptan and ethyl mercaptan, alkyl-sulfides such as methyl sulfide, alkylamines such as methyl amine, alkyl-ethers such as dimethyl ether, diethyl ether and methylethyl ether, alkyl-halides such as methyl chloride and ethyl chloride, alkyl ketones such as dimethyl ketone, formaldehydes, and various acids such as acetic acid.

In a preferred embodiment of the process of the invention, the feedstock contains one or more oxygenates, more specifically, one or more organic compound(s) containing at least one oxygen atom. In the most preferred embodiment of the process of invention, the oxygenate in the feedstock is one or more alcohol(s), preferably aliphatic alcohol(s) where the aliphatic moiety of the alcohol(s) has from 1 to 20 carbon atoms, preferably from 1 to 10 carbon atoms, and most preferably from 1 to 4 carbon atoms. The alcohols useful as feedstock in the process of the invention include lower straight and branched chain aliphatic alcohols and their unsaturated counterparts. Non-limiting examples of oxygenates include methanol, ethanol, n-propanol, isopropanol, methyl ethyl ether, dimethyl ether, diethyl ether, di-isopropyl ether, formaldehyde, dimethyl carbonate, dimethyl ketone, acetic acid, and mixtures thereof. In the most preferred embodiment, the feedstock is selected from one or more of methanol, ethanol, dimethyl ether, diethyl ether or a combination thereof, more preferably methanol and dimethyl ether, and most preferably methanol.

The various feedstocks discussed above, particularly a feedstock containing an oxygenate, more particularly a feedstock containing an alcohol, is converted primarily into one or more olefin(s). The olefin(s) or olefin monomer(s) produced from the feedstock typically have from 2 to 30 carbon atoms, preferably 2 to 8 carbon atoms, more preferably 2 to 6 carbon atoms, still more preferably 2 to 4 carbons atoms, and most preferably ethylene an/or propylene.

Non-limiting examples of olefin monomer(s) include ethylene, propylene, butene-1, pentene-1,4-methyl-pentene-1, hexene-1, octene-1 and decene-1, preferably ethylene, propylene, butene-1, pentene-1,4-methyl-pentene-1, hexene-1, octene-1 and isomers thereof. Other olefin monomer(s) include unsaturated monomers, diolefins having 4 to 18 carbon atoms, conjugated or nonconjugated dienes, polyenes, vinyl monomers and cyclic olefins.

In the most preferred embodiment, the feedstock, preferably of one or more oxygenates, is converted in the presence of a molecular sieve catalyst composition into olefin(s) having 2 to 6 carbons atoms, preferably 2 to 4 carbon atoms. Most preferably, the olefin(s), alone or combination, are converted from a feedstock containing an oxygenate, preferably an alcohol, most preferably methanol, to the preferred olefin(s) ethylene and/or propylene.

The most preferred process is generally referred to as gas-to-olefins (GTO) or alternatively, methanol-to-olefins (MTO). In a MTO process, typically an oxygenated feedstock, most preferably a methanol containing feedstock, is converted in the presence of a molecular sieve catalyst composition into one or more olefins, preferably and predominantly, ethylene and/or propylene, often referred to as light olefins.

The feedstock, in one embodiment, contains one or more diluents, typically used to reduce the concentration of the feedstock. The diluents are generally non-reactive to the feedstock or molecular sieve catalyst composition. Non-limiting examples of diluents include helium, argon, nitrogen, carbon monoxide, carbon dioxide, water, essentially non-reactive paraffins (especially alkanes such as methane, ethane, and propane), essentially non-reactive-aromatic compounds, and mixtures thereof. The most preferred diluents are water and nitrogen, with water being particularly preferred. In other embodiments, the feedstock does not contain any diluent.

The diluent may be used either in a liquid or a vapor form, or a combination thereof. The diluent is either added directly to a feedstock entering into a reactor or added directly into a reactor, or added with a molecular sieve catalyst composition. In one embodiment, the amount of diluent in the feedstock is in the range of from about 1 to about 99 mole percent based on the total number of moles of the feedstock and diluent, preferably from about 1 to 80 mole percent, more preferably from about 5 to about 50, most preferably from about 5 to about 25. In one embodiment, other hydrocarbons are added to a feedstock either directly or indirectly, and include olefin(s), paraffin(s), aromatic(s) (see for example U.S. Pat. No. 4,677,242, addition of aromatics) or mixtures thereof, preferably propylene, butylene, pentylene, and other hydrocarbons having 4 or more carbon atoms, or mixtures thereof.

The process for converting a feedstock, especially a feedstock containing one or more oxygenates, in the presence of a molecular sieve catalyst composition of the invention, is carried out in a reaction process in a reactor, where the process is a fixed bed process, a fluidized bed process (includes a turbulent bed process), preferably a continuous fluidized bed process, and most preferably a continuous high velocity fluidized bed process.

The reaction processes may take place in a variety of catalytic reactors such as hybrid reactors that have a dense bed or fixed bed reaction zones and/or fast fluidized bed reaction zones coupled together, circulating fluidized bed reactors, riser reactors, and the like. Suitable conventional reactor types are described in for example U.S. Pat. No. 4,076,796, U.S. Pat. No. 6,287,522 (dual riser), and *Fluidization Engineering*, D. Kunii and O. Levenspiel, Robert E. Krieger Publishing Company, New York, New York 1977, which are all herein fully incorporated by reference. Dual riser reactors or other reactor designs optionally include a plurality of feed introduction nozzles, which may be formed and/or coated with a material resistant to the formation of metal catalyzed side reaction byproducts in accordance with the present invention.

The preferred reactor type are riser reactors generally described in *Riser Reactor, Fluidization and Fluid-Particle Systems*, pages 48 to 59, F. A. Zenz and D. F. Othmer, Reinhold Publishing Corporation, New York, 1960, and U.S. Pat. No. 6,166,282 (fast-fluidized bed reactor), and U.S. patent application Ser. No. 09/564,613 filed May 4, 2000 (multiple riser reactor), which are all herein fully incorporated by reference.

In an embodiment, the amount of fresh feedstock fed separately or jointly with a vapor feedstock, to a reactor system is in the range of from 0.1 weight percent to about 95 weight percent, preferably from about 10 weight percent to about 90 weight percent, more preferably from about 50 weight percent to about 85 weight percent based on the total weight of the feedstock including oxygenate recycle and any diluent contained therein. The liquid and vapor feedstocks are preferably the same composition, or contain varying proportions of the same or different feedstock with the same or different diluent.

The conversion temperature employed in the conversion process, specifically within the reactor system, is in the range of from about 200° C. to about 1000° C., preferably from about 250° C. to about 800° C., more preferably from about 250° C. to about 750° C., yet more preferably from about 300° C. to about 650° C., yet even more preferably from about 350° C. to about 600° C. most preferably from about 350° C. to about 550° C.

The conversion pressure employed in the conversion process, specifically within the reactor system, varies over a wide range including autogenous pressure. The conversion pressure is based on the partial pressure of the feedstock exclusive of any diluent therein. Typically the conversion pressure employed in the process is in the range of from about 0.1 kPaa to about 5 MPaa, preferably from about 5 kPaa to about 1 MPaa, and most preferably from about 20 kPaa to about 500 kpaa.

The weight hourly space velocity (WHSV), particularly in a process for converting a feedstock containing one or more oxygenates in the presence of a molecular sieve catalyst composition within a reaction zone, is defined as the total weight of the feedstock excluding any diluents to the reaction zone per hour per weight of molecular sieve in the molecular sieve catalyst composition in the reaction zone. The WHSV is maintained at a level sufficient to keep the catalyst composition in a fluidized state within a reactor.

Typically, the WHSV ranges from about 1 $hr^{-1}$ to about 5000 $hr^{-1}$, preferably from about 2 $hr^{-1}$ to about 3000 $hr^{-1}$, more preferably from about 5 $hr^{-1}$ to about 1500 $hr^{-1}$, and most preferably from about 10 $hr^{-1}$ to about 1000 $hr^{-1}$. In one preferred embodiment, the WHSV is greater than 20 $hr^{-1}$, preferably the WHSV for conversion of a feedstock containing methanol, dimethyl ether, or both, is in the range of from about 20 $hr^{-1}$ to about 300 $hr^{-1}$.

The superficial gas velocity (SGV) of the feedstock including diluent and reaction products within the reactor system is preferably sufficient to fluidize the molecular sieve catalyst composition within a reaction zone in the reactor. The SGV in the process, particularly within the reactor system, more particularly within the riser reactor(s), is at least 0.1 meter per second (m/sec), preferably greater than 0.5 m/sec, more preferably greater than 1 m/sec, even more preferably greater than 2 m/sec, yet even more preferably greater than 3 m/sec, and most preferably greater than 4 m/sec. See for example U.S. patent application Ser. No. 09/708,753 filed Nov. 8, 2000, which is herein incorporated by reference.

Having now fully described the invention, it will be appreciated by those skilled in the art that the invention may be performed within a wide range of parameters within what is claimed, without departing from the spirit and scope of the invention.

We claim:

1. A process for modifying a tanker to carry methanol, the process comprising the steps of:

(a) providing the tanker, wherein the tanker comprises one or more holds that previously stored a non-methanol material; and (b) providing a fire suppression system for delivering an alcohol resistant fire suppression agent to the one or more holds, wherein the fire suppression system comprises a fire suppression conduit system for delivering the alcohol resistant fire suppression agent to the one or more holds.

2. The process of claim 1, wherein step (b) comprises replacing a preexisting pump with a second pump having a greater volumetric output than the preexisting pump.

3. The process of claim 1, wherein the fire suppression agent is a foam.

4. The process of claim 1, wherein step (b) comprises replacing a first suppression agent storage tank with a second suppression agent storage tank having a larger storage volume than the first suppression agent storage tank.

5. The process of claim 1, wherein step (b) comprises supplementing a first suppression agent storage tank with a second suppression agent storage tank.

6. The process of claim 1, wherein step (b) comprises modifying a first suppression agent storage tank to increase its storage volume.

7. The process of claim 1, wherein step (b) comprises replacing a preexisting conduit system with the fire suppression conduit system having a greater flow capacity than the preexisting conduit system, the fire suppression conduit system being adapted to provide the alcohol resistant fire suppressing agent to the one or more holds.

8. The process of claim 1, wherein step (b) comprises supplementing a preexisting conduit system with the fire suppression conduit system, the preexisting and fire suppression conduit systems being adapted to provide the alcohol resistant fire suppressing agent to the one or more holds.

9. The process of claim 1, wherein the process further comprises the step of:

(c) providing a blanketing system for delivering a blanketing medium through blanketing conduits and into the one or more holds.

10. The process of claim 9, wherein the blanketing medium comprises exhaust from a kerosene burning engine.

11. The process of claim 9, wherein the blanketing medium comprises exhaust gases from a diesel engine or burner.

12. The process of claim 9, wherein the blanketing medium comprises exhaust gases from a gas oil burning engine or burner.

13. The process of claim 9, wherein the blanketing medium comprises exhaust gases from a methanol engine or burner.

14. The process of claim 9, wherein the blanketing medium comprises carbon dioxide.

15. The process of claim 1, wherein the process further comprises the step of:

(c) cleaning the one or more holds with a cleaning agent to remove residual deposits from the non-methanol material.

16. The process of claim 15, wherein step (c) comprises:

washing the one or more holds with a first cleaning agent comprising water, washing the one or more holds with a second cleaning agent comprising an emulsifier, and rinsing the emulsifier from the one or more holds with a water rinse.

17. The process of claim 1, wherein the non-methanol material comprises crude oil.

18. The process of claim 1, wherein the non-methanol material comprises naphtha.

19. The process of claim 9, wherein the blanketing medium is selected from the group consisting of: exhaust from a diesel engine, exhaust from a kerosene engine, exhaust from a gasoline engine, exhaust from a methanol engine, exhaust from a gas oil engine, flue gas from a diesel burner, flue gas from a kerosene burner, flue gas from a gasoline burner, flue gas from a methanol burner, and flue gas from a gas oil burner.

20. The process of claim 1, wherein the one or more holds include an uncoated inner surface.

21. The process of claim 1, wherein the tanker has a total deadweight of at least 20,000 DWT.

22. The process of claim 21, wherein the total deadweight is at least 35,000 DWT.

23. The process of claim 22, wherein the total deadweight is at least 70,000 DWT.

24. The process of claim 23, wherein the total deadweight is at least 125,000 DWT.

25. The process of claim 1, wherein the tanker comprises one or more alcohol intolerant seals, the process further comprising the step of:

(c) replacing the alcohol intolerant seals with alcohol resistant seals.

26. The process of claim 1, wherein the tanker comprises one or more alcohol intolerant gaskets, the process further comprising the step of:

(c) replacing the alcohol intolerant gaskets with alcohol resistant gaskets.

27. The process of claim 1, wherein the process further comprises the step of:

(c) removing oil from the tanker.

28. The process of claim 1, wherein the process further comprises the step of:

(c) removing naphtha from the tanker.

29. A tanker adapted to carry methanol-to-olefin grade methanol, the tanker comprising:

(a) a hold for storing the methanol-to-olefin grade methanol;

(b) a fire suppression system comprising a storage tank for storing an alcohol resistant fire suppressing agent, and a conduit system for delivering the alcohol resistant fire suppressing agent to the hold; and (c) a blanketing system which can deliver a blanketing medium into the hold, wherein the blanketing medium is selected from the group consisting of: exhaust from a diesel engine, exhaust from a kerosene engine, exhaust from a gasoline engine, exhaust from a methanol burning engine, exhaust from a gas oil engine, flue gas from a diesel burner, flue gas from a kerosene burner, flue gas from a gasoline burner, flue gas from a methanol burner, and flue gas from a gas oil burner.

30. The tanker of claim 29, wherein the tanker further comprises:

(d) one or more alcohol resistant gaskets.

31. The tanker of claim 29, wherein the blanketing medium is selected from the group consisting of exhaust from the diesel engine, and flue gas from the diesel burner.

32. The tanker of claim 29, wherein the blanketing medium is selected from the group consisting of exhaust from the kerosene engine, and flue gas from the kerosene burner.

33. The tanker of claim 29, wherein the blanketing medium is selected from the group consisting of exhaust from the gasoline engine, and flue gas from the gasoline burner.

34. The tanker of claim 29, wherein the blanketing medium is selected from the group consisting of exhaust from the gas oil engine, and flue gas from the gas oil burner.

35. The tanker of claim 29, wherein the blanketing medium comprises carbon dioxide.

36. The tanker of claim 29, wherein the blanketing medium comprises soot.

37. The tanker of claim 29, wherein the hold comprises an uncoated inner surface.

38. The tanker of claim 29, wherein the tanker has a total deadweight of at least 20,000 DWT.

39. The tanker of claim 38, wherein the total deadweight is at least 35,000 DWT.

40. The tanker of claim 39, wherein the total deadweight is at least 70,000 DWT.

41. The tanker of claim 40, wherein the total deadweight is at least 125,000 DWT.

42. The tanker of claim 29, wherein the tanker further comprises:

(d) one or more alcohol resistant seals.

43. A methanol blanketing system, comprising:

(a) a blanketing medium generator in a tanker for generating a blanketing medium selected from the group consisting of: exhaust from a diesel engine, exhaust from a kerosene engine, exhaust from a gasoline engine, exhaust from a methanol burning engine, exhaust from a gas oil engine, flue gas from a diesel burner, flue gas from a kerosene burner, flue gas from a gasoline burner, flue gas from a methanol burner, and flue gas from a gas oil burner; and (b) a conduit system in communication with the blanketing medium generator and one or more holds, wherein the blanketing medium is directed through the conduit system to the one or more holds, the holds being at least partially filled with a fluid cargo comprising methanol.

44. The methanol blanketing system of claim 43, wherein the blanketing medium is selected from the group consisting of exhaust from the diesel engine, and flue gas from the diesel burner.

45. The methanol blanketing system of claim 43, wherein the blanketing medium is selected from the group consisting of exhaust from the kerosene engine, and flue gas from the kerosene burner.

46. The methanol blanketing system of claim 43, wherein the blanketing medium is selected from the group consisting of exhaust from the gasoline engine, and flue gas from the gasoline burner.

47. The methanol blanketing system of claim 43, wherein the blanketing medium is selected from the group consisting of exhaust from the gas oil engine, and flue gas from the gas oil burner.

48. The methanol blanketing system of claim 43, wherein the blanketing medium comprises carbon dioxide.

49. The methanol blanketing system of claim 43, wherein the blanketing medium comprises carbon monoxide.

50. The methanol blanketing system of claim 43, wherein the blanketing medium comprises soot.

51. The methanol blanketing system of claim 43, wherein the fluid cargo comprises carbonic acid.

52. The methanol blanketing system of claim 43, wherein the blanketing medium comprises $SO_x$.

53. The methanol blanketing system of claim 43, wherein the blanketing medium comprises particulate contaminants.

54. The methanol blanketing system of claim 43, wherein the blanketing medium is selected from the group consisting of exhaust from the methanol engine, and flue gas from the methanol burner.

55. The methanol blanketing system of claim 43, wherein the one or more holds include an uncoated inner surface.

56. The methanol blanketing system of claim 43, wherein the tanker has a total deadweight of at least 20,000 DWT.

57. The methanol blanketing system of claim 56, wherein the total deadweight is at least 35,000 DWT.

58. The methanol blanketing system of claim 57, wherein the total deadweight is at least 70,000 DWT.

59. The methanol blanketing system of claim 58, wherein the total deadweight is at least 125,000 DWT.

60. A process for unloading methanol from a tanker, the process comprising the steps of:

(a) withdrawing methanol from a hold; and (b) replacing the volume of withdrawn methanol with a blanketing medium, wherein the blanketing medium is selected from the group consisting of: exhaust from a diesel engine, exhaust from a kerosene engine, exhaust from a gasoline engine, exhaust from a methanol burning engine, exhaust from a gas oil engine, flue gas from a diesel burner, flue gas from a kerosene burner, flue gas from a gasoline burner, flue gas from a methanol burner, and flue gas from a gas oil burner.

61. The process of claim 60, wherein the blanketing medium is selected from the group consisting of exhaust from the diesel engine, and flue gas from the diesel burner.

62. The process of claim 60, wherein the blanketing medium is selected from the group consisting of exhaust from the kerosene engine, and flue gas from the kerosene burner.

63. The process of claim 60, wherein the blanketing medium is selected from the group consisting of exhaust from the gasoline engine, and flue gas from the gasoline burner.

64. The process of claim 60, wherein the blanketing medium is selected from the group consisting of exhaust from the gas oil engine, and flue gas from the gas oil burner.

65. The process of claim 60, wherein the blanketing medium is selected from the group consisting of exhaust from the methanol engine, and flue gas from the methanol burner.

66. The process of claim 60, wherein the blanketing medium comprises carbon dioxide.

67. The process of claim 60, wherein the blanketing medium comprises carbon monoxide.

68. The process of claim 60, wherein the blanketing medium comprises soot.

69. The process of claim 60, wherein the methanol comprises carbonic acid.

70. The process of claim 60, wherein the blanketing medium comprises $SO_x$.

71. The process of claim 60, wherein the blanketing medium comprises particulate contaminants.

72. The process of claim 60, wherein the hold includes an uncoated inner surface.

73. The process of claim 60, wherein the tanker has a total deadweight of at least 20,000 DWT.

74. The process of claim 73, wherein the total deadweight is at least 35,000 DWT.

75. The process of claim 74, wherein the total deadweight is at least 70,000 DWT.

76. The process of claim 75, wherein the total deadweight is at least 125,000 DWT.

* * * * *